US005390470A

United States Patent [19]

Brunini et al.

[11] Patent Number: 5,390,470

[45] Date of Patent: Feb. 21, 1995

[54] MACHINE FOR THE PRODUCTION OF PLASTIC FILM BAGS WITH MEANS OF POSITIONING WITH RESPECT TO EACH OTHER THE TRAILING END OF A FILM BEING USED UP AND THE LEADING END OF A RESERVE FILM

[75] Inventors: Pietro P. Brunini; Alberto Mangani, both of Pistoia, Italy

[73] Assignee: Garibaldo Ricciarelli S.R.L., Pistoia, Italy

[21] Appl. No.: 48,265

[22] Filed: Apr. 14, 1993

[51] Int. Cl.[6] ..... B65H 19/10; B65B 41/18

[52] U.S. Cl. ..... 53/64; 53/168; 53/389.3; 53/567

[58] Field of Search ..... 53/168, 567, 568, 389.3, 53/64; 242/58.6, 58.1, 55.3, 55.2

[56] References Cited

U.S. PATENT DOCUMENTS

| | | | |
|---|---|---|---|
| 3,325,071 | 6/1967 | Schmitz | 53/168 X |
| 4,185,442 | 1/1980 | Johnson et al. | 53/168 |
| 4,774,796 | 10/1988 | Aiuola et al. | 53/168 |
| 4,800,705 | 1/1989 | Bodolay | 53/168 |
| 4,825,622 | 5/1989 | Nigg | 53/168 X |

FOREIGN PATENT DOCUMENTS

| | | | |
|---|---|---|---|
| 0061788 | 2/1982 | European Pat. Off. | B65H 19/10 |
| 0211291 | 7/1986 | European Pat. Off. | B65H 21/02 |
| 0291472 | 4/1988 | European Pat. Off. | B65H 19/16 |
| 0464003 | 6/1991 | European Pat. Off. | B65H 19/10 |

*Primary Examiner*—James F. Coan
*Attorney, Agent, or Firm*—McGlew & Tuttle

[57] ABSTRACT

A machine for the production of weldable plastic film bags from a strip reel, and for the filling of the said bags, comprises means of supporting and unwinding a first strip reel ($B_1$); means of supporting a second reserve strip reel ($B_2$); and means (41, 49) of cutting and welding the strip (N), to automatically make the join between the trailing end of the strip being unwound from the first reel ($B_1$) and the leading end of the strip on the second reel ($B_2$) when the first reel is about to be used up. In order to bring the strip on reel ($B_1$) into phase with the strip on reel ($B_2$), there are provided means (5, 7, 9) of delimiting a predetermined length of the path of the strip between the means of forming, filling and sealing the bags and the means (41, 49) of cutting and welding the strip; a first reference (151) down-line from the means of welding and cutting the strip; and a second reference (153) for the strip from the second reel.

15 Claims, 5 Drawing Sheets

MACHINE FOR THE PRODUCTION OF PLASTIC FILM BAGS WITH MEANS OF POSITIONING WITH RESPECT TO EACH OTHER THE TRAILING END OF A FILM BEING USED UP AND THE LEADING END OF A RESERVE FILM

DESCRIPTION

1. Field of the Invention

The invention relates to a machine for the production of weldable plastic film bags, from a strip reel, and for the filling of the said bags, comprising: means of supporting and unwinding a first strip reel; means of supporting a second, reserve strip reel; means of cutting and welding the strip to automatically make the join between the trailing end of the strip being unwound from the first reel and the leading end of the strip on the second reel when the first reel is about to be used up, these means of cutting and welding comprising a movable bar on which is retained the front edge of the strip on the second reel; and means of forming, filling and sealing the bags.

2. Background of the Invention

The means for performing the welding and transverse cutting of the strips to join the strip being used up to the reserve strip are described in Italian Patent Application No. 9416 A/90 and in European Patent Application EP-A-0,464,003 in the name of the present applicant, which are incorporated in the present description.

Machines of this type are commonly used for the production and filling of bags with loose material, especially a food product such as pasta or similar. In many cases, the bags produced by the machine carry printed matter which must be centred with respect to the upper and lower sealing edge of the bag. For this purpose, reference tags are provided on the strip for a photocell which controls the operation of the pincers used to cut and weld the bottoms and tops of the bags which are filled in succession by the machine. These tags are positioned in such a way that the printed area of the strip is centred between the upper and lower edges of each bag.

When a strip for the forming of bags is nearly used up, it has to be welded to the strip on a reserve reel. The cited European patent application EP-A-0,464,003 describes a system to perform this welding automatically.

SUMMARY AND OBJECTS OF THE INVENTION

The object of the present invention is to propose an improved machine which enables the welding between the strips to be performed automatically, keeping the printed areas of the welded strips in phase, so that the production and filling of the bags may take place continuously and without discards, using the portion of strip which contains the weld between the strips from the reel being used up and from the new reserve reel.

The machine according to the invention is substantially characterised by the fact that it comprises: means of delimiting a predetermined length of the path of the strip between the means of forming, filling and sealing the bags and the means of cutting and welding the strip; a first reference, down-line from the means of welding and cutting the strip, for the strip from the first reel; and a second reference, up-line from the means of welding and cutting, for the strip from the reserve reel.

With the means described above it is possible to bring the reserve strip into phase with the strip being supplied. The procedures which permit this bringing into phase will be described in greater detail with reference to the illustrative examples.

Further advantageous embodiments of the machine according to the invention are illustrated in the attached claims.

BRIEF DESCRIPTION OF THE DRAWINGS

The invention will be more clearly understood by following the description and the attached drawing, which shows a practical non-restrictive illustrative embodiment of the invention. In the drawing.

DETAILED DESCRIPTION OF THE PREFERRED EMBODIMENTS

Figure 1:
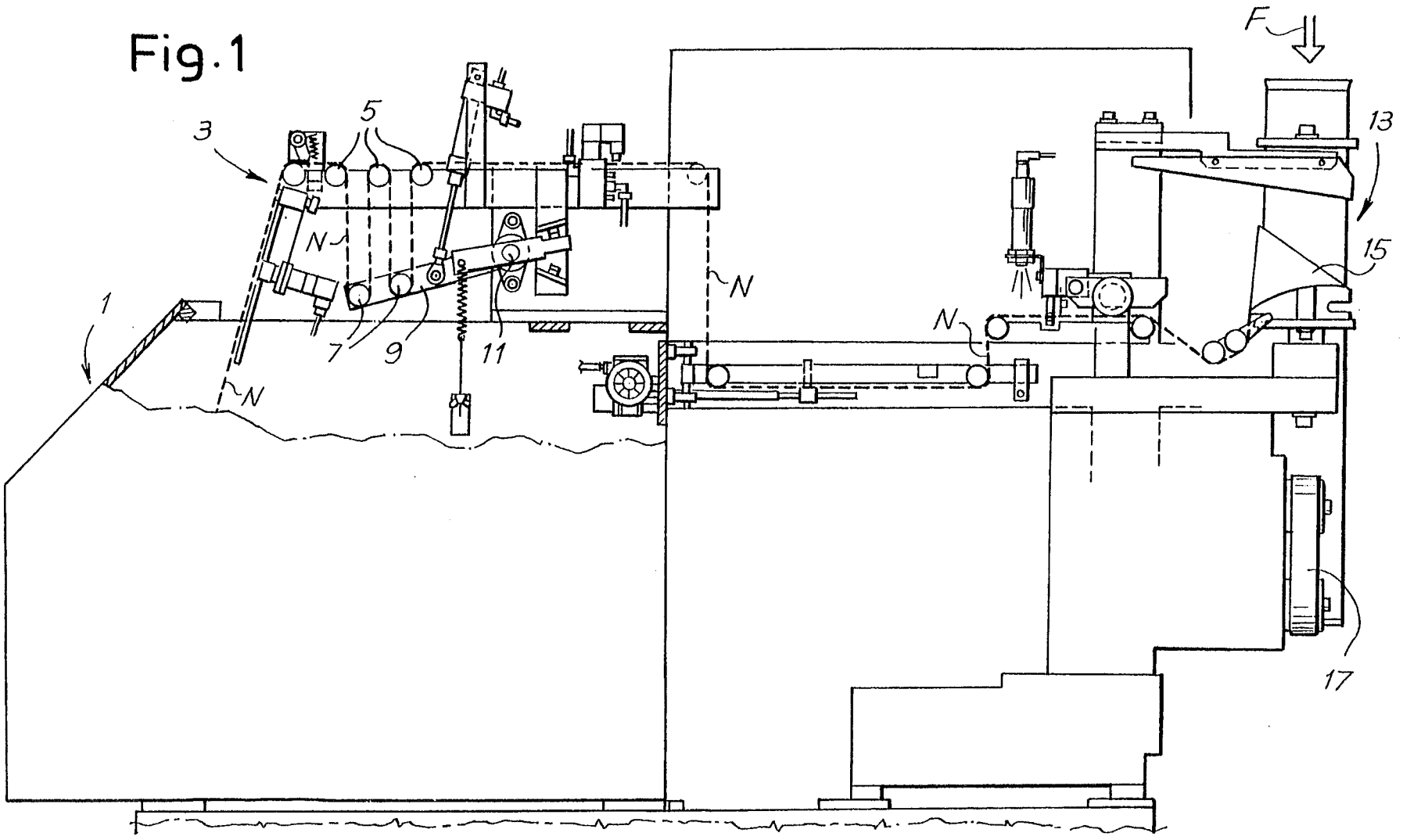
FIG. 1 is a schematic side view, with parts removed, of a machine for the production of bags made of strips of weldable material and for the filling of the said bags with loose material, to which the improvement of the present invention may be applied.

According to what is indicated in a general way in the diagram in FIG. 1, the machine has a first section, indicated as a whole by 1, which contains the operating and reserve reels, together with the means for cutting and welding the strips to weld the trailing end of the strip being used up to the leading end of the strip on the reserve reel. The details of this part of the machine are illustrated in the enlarged section in FIG. 2 and are omitted in the diagram in FIG. 1 for greater clarity. Above section 1 there is provided a section 3 comprising an accordion fold of the strip N formed by a first set of fixed return rollers 5 and by a second set of movable return rollers 7 mounted on an arm 9 which oscillates about a pivot point 11. The accordion fold in section 3 enables the strip N to be fed to the subsequent station of forming, filling and closing of the bags without causing tension in the strip, thus substantially disconnecting the means of traction of the strip in the bag-forming section from the means of unwinding of the feed strip reel.

13 indicates as a whole a section for forming the bag, and for filling and welding it. Section 13 is of a type known in itself and will not, therefore, be described in detail. In the drawing, F indicates only the direction of feed of the loose material for the filling of the bag and 15 indicates the collar enabling the strip N to be shaped to form the bag which is filled with loose material, for example a food product, and drawn downwards by a system of belts 17. Section 13 also comprises the pincers, not visible in the diagram in FIG. 1, for welding and cutting the filled bags.

Figure 2:
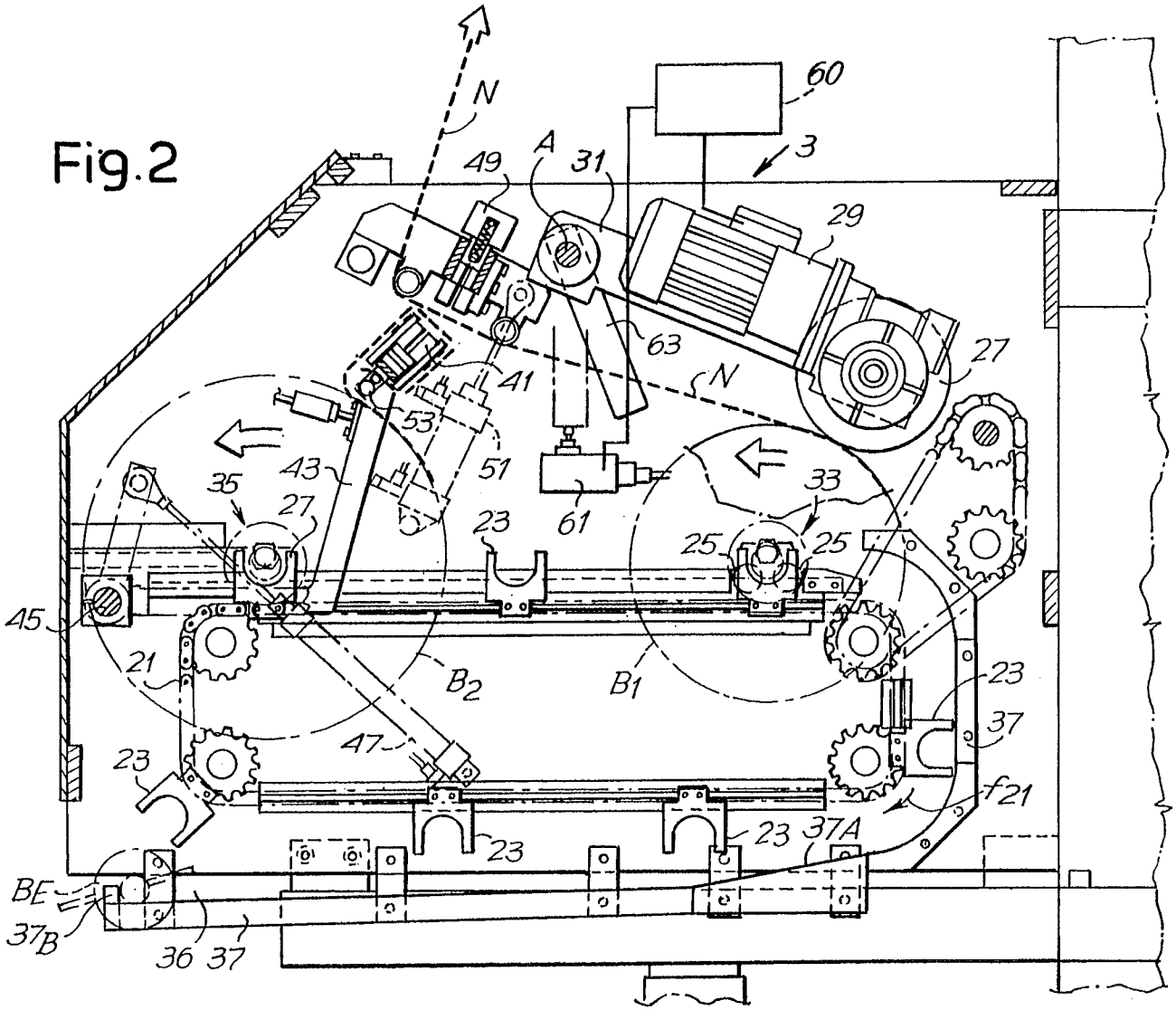
FIG. 2 is a longitudinal section of the area for the joining of the strip or film of plastic material with the details omitted from the diagram in FIG. 1.

FIG. 2 shows an enlargement of section 1. 21 indicates a chain conveyor on which are mounted at regular intervals means of support 23, on which rest the strip reels N. Of course, two parallel conveyors 21 are provided within section 3, one on each side of the machine, and the corresponding means of support 23 receive the corresponding ends of the centre or core on which are wound the reels of material in strip form N.

As may be seen in FIG. 2, the conveyor belt enables a first reel $B_1$ to be positioned in a first operating position—indicated by 33—in which the reel rests, by means of the projecting ends of the core on which the strip N is wound, on free-running rollers 25 which enable the reel to be unwound easily. The reel which is in this position is in contact with an unwinding cylinder 27, which may advantageously be rubber-coated, driven by an unwinding motor 29 carried by a moving element 31 pivoted so that it can oscillate about a horizontal axis A which is transverse with respect to the direction of advance of the strip N. The roller 27 is kept in contact with the cylindrical surface of the reel $B_1$ by the intrinsic weight of the motor 29 and of the moving element 31. The rotating of the cylinder 27 by the action of the motor 29 causes the gradual unwinding of the reel $B_1$ and the feeding of the strip N to the means of production, filling and sealing of the bags.

The conveyor 21 also enables a second reel $B_2$, also indicated as a spare or reserve reel, to be positioned in a waiting position, indicated by 35. Positions 33 and 35 are substantially aligned on the upper frame of the conveyor 21.

When the reel $B_2$ in position 33 has been used up and the trailing end of the strip N being unwound from the said reel has been welded to the leading end of the strip on reel $B_2$, by the procedures described in Patent Application EP-A-0,464,003, the conveyor 21 proceeds, by a movement in the direction f21, to move the empty reel from the upper frame to the lower frame of the conveyor 21. On this lower frame there is provided a discharge position 36 of the empty reel, indicated by BE in the figure. Along the extension of the descending frame and of the lower horizontal frame of the conveyor 21 there is provided a guide 37 which enables the empty reel to be retained in its means of support 23 until it reaches an inclined section 37A of the guide. When the means of support 23 carrying the empty reel arrives above the inclined portion 37A of the guide 37, the empty reel BE is released onto this portion of the guide and rolls towards a stop 37B located at the bottom of the guide 37. From this position the empty reel may be removed manually.

FIG. 2 also shows the system for welding the strips from the reels $B_1$ and $B_2$. This system includes, as described previously in European Patent Application EP-A-0,464,003, a bar 41 carried by an oscillating arm 43 hinged at 45 to the frame of the machine. A cylinder and piston system 47 actuates the oscillation of the arm 43 and consequently of the bar 41 into the active position illustrated in FIG. 2. In this position the bar 41 is ready to co-operate with a counter-bar 49 which may be brought in front of the bar 41 by means of a cylinder and piston system 51. The counter-bar 49 has inside it a cutting blade (not illustrated in detail in the drawing) which may be made to emerge to penetrate into a corresponding groove in the bar 41. On one side of the cutting blade there is disposed a welding bar to weld the trailing end of the strip from the reel $B_1$ to the leading end of the strip from the reel $B_2$.

When the reel $B_2$ is in the waiting position and the reel $B_1$ is supplying the strip to the machine for the production of the bags—in other words, when the machine is in the state illustrated in FIG. 2—the free edge, in other words the leading edge of the strip wound on the reel $B_2$, is retained on the bar 41 by means of a mechanical retention system indicated as a whole by 53 and forming the subject of a simultaneous patent application in the name of the present applicant and not described in detail here.

When the reel $B_1$ has been nearly used up, the strip supplied from the said reel must be welded to the leading end of the strip from reel $B_2$, positioned on the bar 41. The operation of joining the two strips is controlled by a central control unit, schematically indicated by 60, which receives a signal according to the diameter reached by the reel $B_1$. The sensing means comprises a microswitch 61 fixed with respect to the frame of the machine and designed to co-operate with a projection 63 fixed to the moving element 31 which carries the motor 29 unwinding the reel $B_1$ and which is hinged about the pivot A of the machine frame. As the reel $B_1$ is unwound, the moving element 31 is lowered, turning about the pivot A, until it brings the projection 63 into contact with the microswitch 61 at the predetermined minimum diameter of the reel $B_1$. The signal emitted at this moment by the microswitch 61 and sent to the central unit 60 causes the activation of the means of welding and cutting comprising the bar 41 and the counter-bar 49.

In order to make the best use of the material in strip form wound on the reel $B_1$, in an improved embodiment of the invention the central unit 60 may be made to delay the activation of the means of welding and transverse cutting of the strip by an interval which may be predetermined with respect to the signal emitted by the microswitch 61. During this delay the machine at least partially uses the strip N still wound on the reel $B_1$. This delay may be set as a function of the speed of advance of the strip N or of the number of bags.

Figure 7:
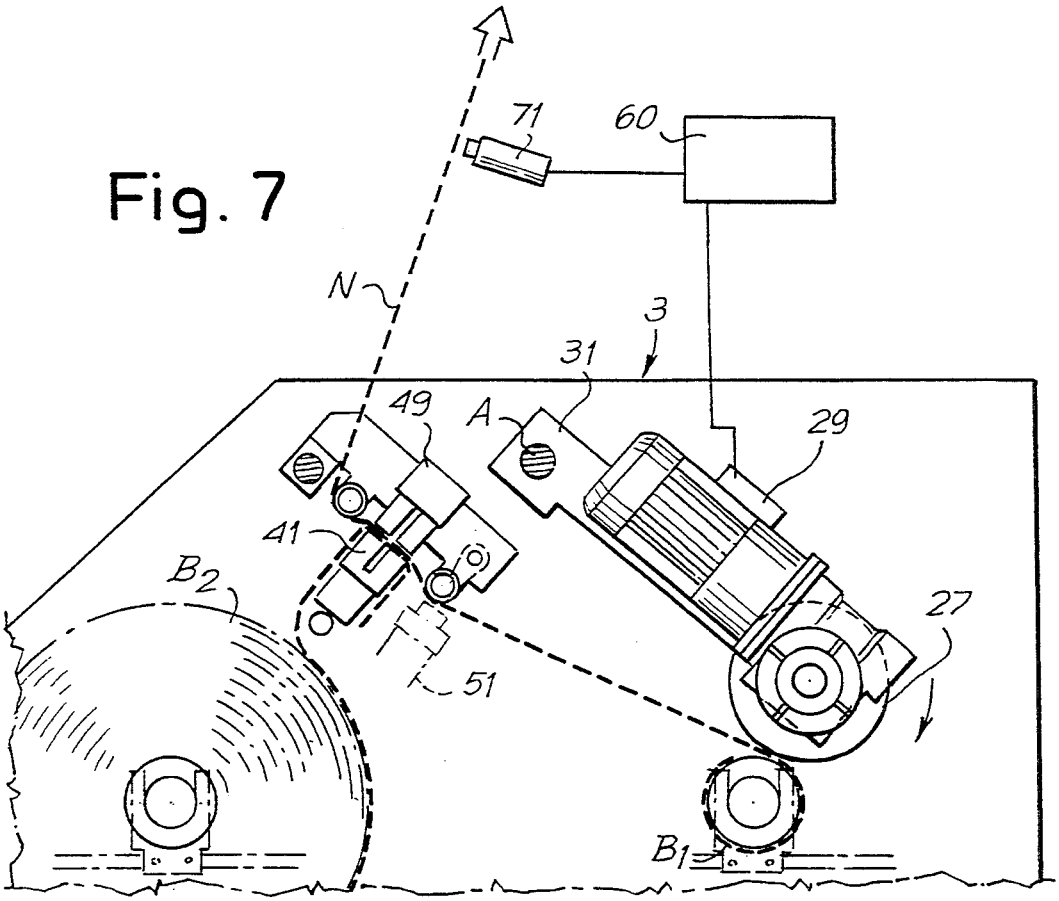
FIG. 7 is a diagram of the means of detection of the using up of the strip on the reel in operation.
Figure 8:
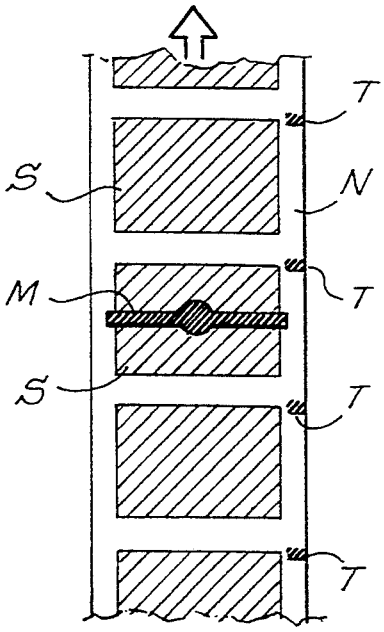
FIG. 8 is a schematic illustration of the final portion of the strip with a first type of mark formed on it.
Figure 9:
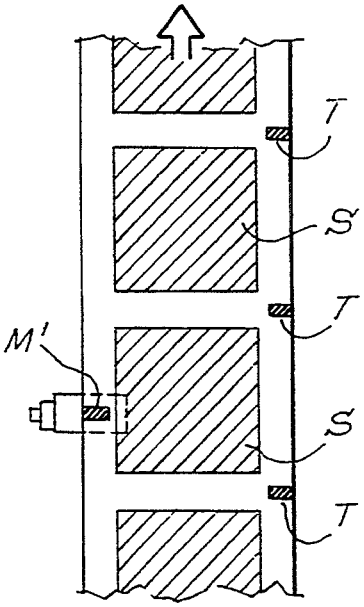
FIG. 9 is a schematic illustration of the final portion of the strip with a mark of the preprinted type.

FIGS. 7 to 9 show a different system of detecting the using up of the first reel and of activating the welding. FIG. 7 schematically shows section 3 of the machine with the indication of a sensing means of the capacitive or optical type, indicated by 71, capable of detecting a mark previously made on the final portion of the strip N being unwound from the reel $B_1$. In this figure the details shown in FIG. 2 are omitted. The sensor 71 is connected to the control unit 60 which causes the carrying belts 17 to stop when the bag being processed has been completed, when the sensor 71 detects the mark near the terminal edge of the strip N.

FIG. 8 shows the trailing end of the strip N with a mark M at a predetermined distance from the final edge of the strip. FIG. 8 also shows schematically the photocell tags T, in other words the tags which enable the machine to weld and cut the individual bags in the intermediate areas between successive printed areas, hatched and indicated by S in the figure.

The mark M may consist of an adhesive metal ribbon applied to the surface of the strip, also and in particular directly before the strip N is wound to form the reel $B_1$. The mark M may be detected with a sensor of the optical type, or, if the strip is made of metal or is metal-coated, additionally with a sensor of a capacitive, inductive or equivalent type.

FIG. 9 shows a modified embodiment of the strip, in which the mark indicated by M′ is produced by printing on the strip, for example together with the printing of the reference tags T and the printed areas S. In this case the mark M′ is detected by a sensor of the optical type.

The two strip end detection systems described above may be used as alternatives and may also be used without the strip phase-control system.

Figure 3:
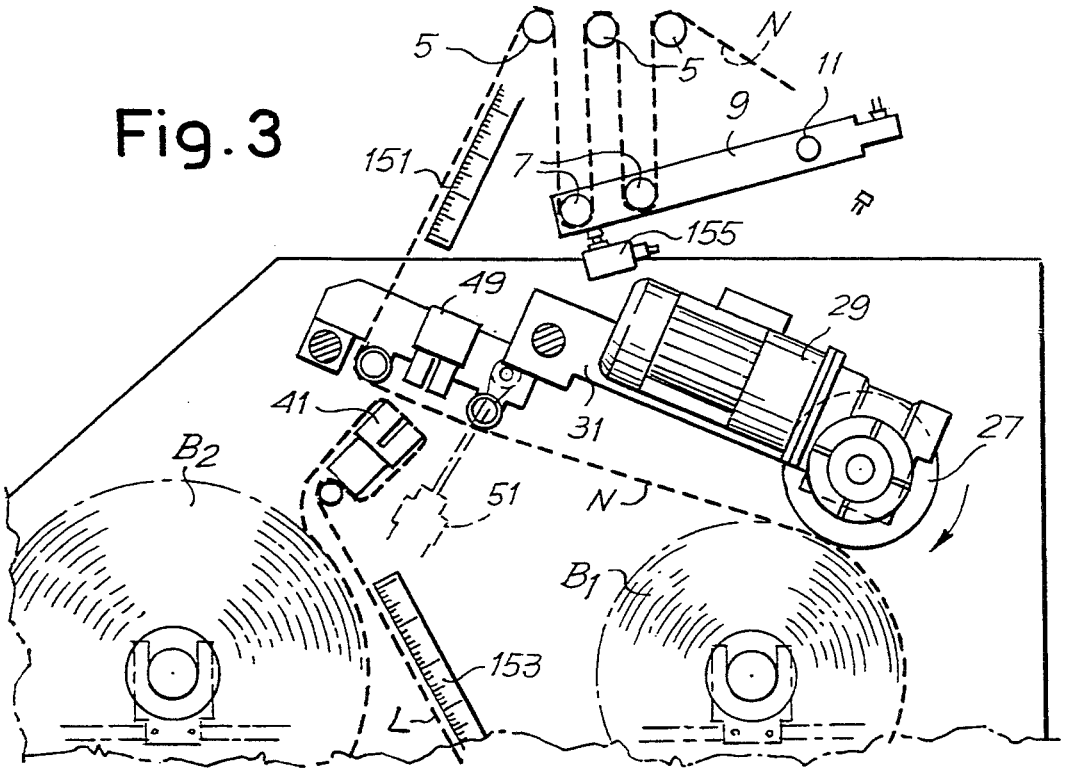
FIGS. 3 and 4 are two diagrams exemplifying two systems for the phasing of the strips.

FIG. 3 is an outline diagram which shows the elements forming a first system for bringing into phase the two strips on reel $B_1$ and reel $B_2$ when the first reel is becoming used up and the strips have to be welded together. In this figure the elements which are essential for the phasing are shown, and the structural elements illustrated in FIG. 2 are omitted.

In this first embodiment, in order to ensure that the strips from reels $B_1$ and $B_2$ are welded in such a way that the printed areas of the two strips are phased, in other words brought into step, a first reference 151, consisting of a graduated scale, fixed with respect to the machine, is provided. The graduated scale 151 is disposed down-line from the means of welding and cutting elements including a first component (bar) 41, 49 and a second component (counter bar), between these and the accordion fold formed by the return rollers 5 and 7. A second graduated scale 153 is disposed under the bar 41.

To obtain the welding in phase of the strips from reels $B_1$ and $B_2$ in the embodiment in FIG. 3, the procedure is as follows.

At the start of the process, the strip from reel $B_1$ is positioned in the machine. Its leading section is fed into the collar 15 and brought up to the welding pincers for the closing and cutting of the bag in such a way that the printed tag on the strip in the area in which the bag is to be sealed and cut is next to the welding pincers of section 13. At this point, while the end of the strip in the welding pincers of section 13 is held in place, the oscillating arm 9 is brought into its lower position illustrated in FIG. 3, in which it cooperates with a microswitch 155. This position of the oscillating arm 9 corresponds to a predetermined length of travel of the strip between the transverse means of welding and cutting elements 41, 49 and the bag welding and cutting pincers in section 13.

In this state, one of the reference tags which are preprinted on the strip and which identify the points of closure and cutting of the bags subsequently formed in section 13 is positioned at a random point on the graduated scale 151. In order to ensure that the transverse means of welding and cutting elements 41, 49 join the strip from reel $B_2$ to the strip from reel $B_1$ at a point such that the reference tags of the two strips are brought into phase (and consequently in such a way as to permit the automatic joining and the continuation of processing of the strip for the formation of bags and filling of the bags without the need to discard the area in which the joining of the two strips take place), it is sufficient for the free edge L of the strip from the reserve reel $B_2$ to be positioned with respect to the graduated scale 153 in such a way that a reference tag on the said strip from reel $B_2$ is brought next to an index on the scale 153 which corresponds to the index on the scale 151 next to the reference tag of the strip from reel $B_1$.

Figure 5:
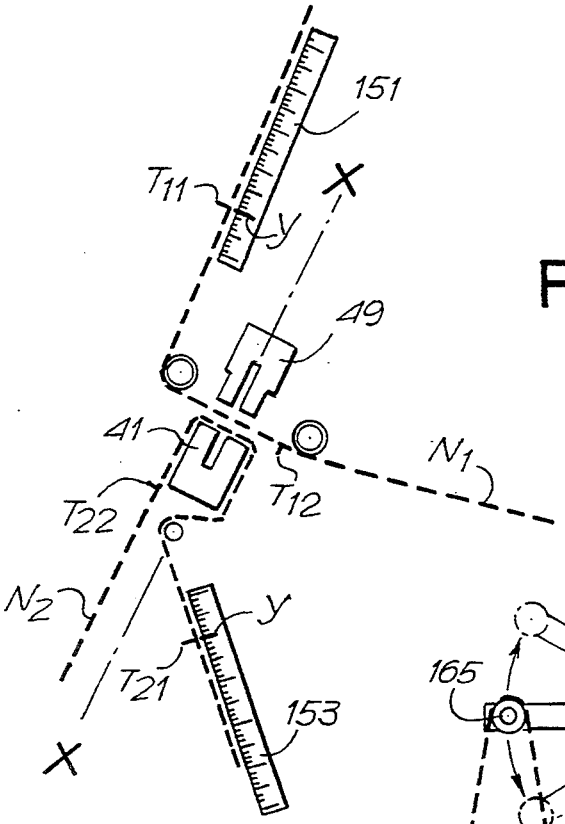
FIG. 5 is an illustrative diagram.

The position of the reference tags on the two strips with respect to the graduated scale is illustrated in the diagram in FIG. 5. In this diagram, T11 and T12 indicate the two consecutive tags on the strip from reel $B_1$, indicated by N1 in this figure. T21 and T22 are two consecutive reference tags on the strip N2 from reel $B_2$. In the initial registration state illustrated in FIG. 5, before the start of the process, tag T11 is next to the index Y on scale 151, while tag T21 is next to the index Y, having the same value, on scale 153. The indices are positioned in such a way that, when X indicates the section in which the joining by means of the bar 41 and counter-bar 49 takes place, the length of strip N1 between tag T11 (and therefore the index Y on scale 151) and section X corresponds to the length of the strip N2 between section X and tag T21 next to index Y on scale 153. In this way, if the joining takes place when one tag on the strip N1 is next to index Y on scale 151, the said joining will take place in such a way that in the joined strip the distance between tags T11 and T22 corresponds to the distance between tags T11 and T12. In this way a perfect phasing of the two strips after joining is obtained.

The operation described above of positioning the tag T11 next to the index Y on scale 151 is performed once only at the start of a processing cycle with a strip characterised by a certain interval between consecutive tags T. When this operation has been performed and consequently when the index Y on scales 151 and 153 has been identified, the processing may be started and may proceed continuously with successive replacements of the reels of strip as they are used up. The operation of cutting and welding by means of the bar and counter-bar 41, 49 always takes place at a position of the strip being used up N1 equivalent to that shown in FIGS. 3 and 5, with arm 9 in the lower reference position in contact with the microswitch 155, one reference tag next to the bag welding pincers of section 13, and one reference tag next to index Y on scale 151. At this point, if the strip N2 on the reserve reel has been correctly positioned with the tag T21 next to index Y on scale 153, the strip being used up N1 and the reserve strip N2 will be kept in step when the welding takes place.

When, on completion of the processing of an order, the strip is replaced with a strip characterised by a different interval between the reference tags, it is necessary to perform another registration operation to find a new index Y on scales 151 and 153 at which the reference tags of the strips must be positioned.

Figure 4:
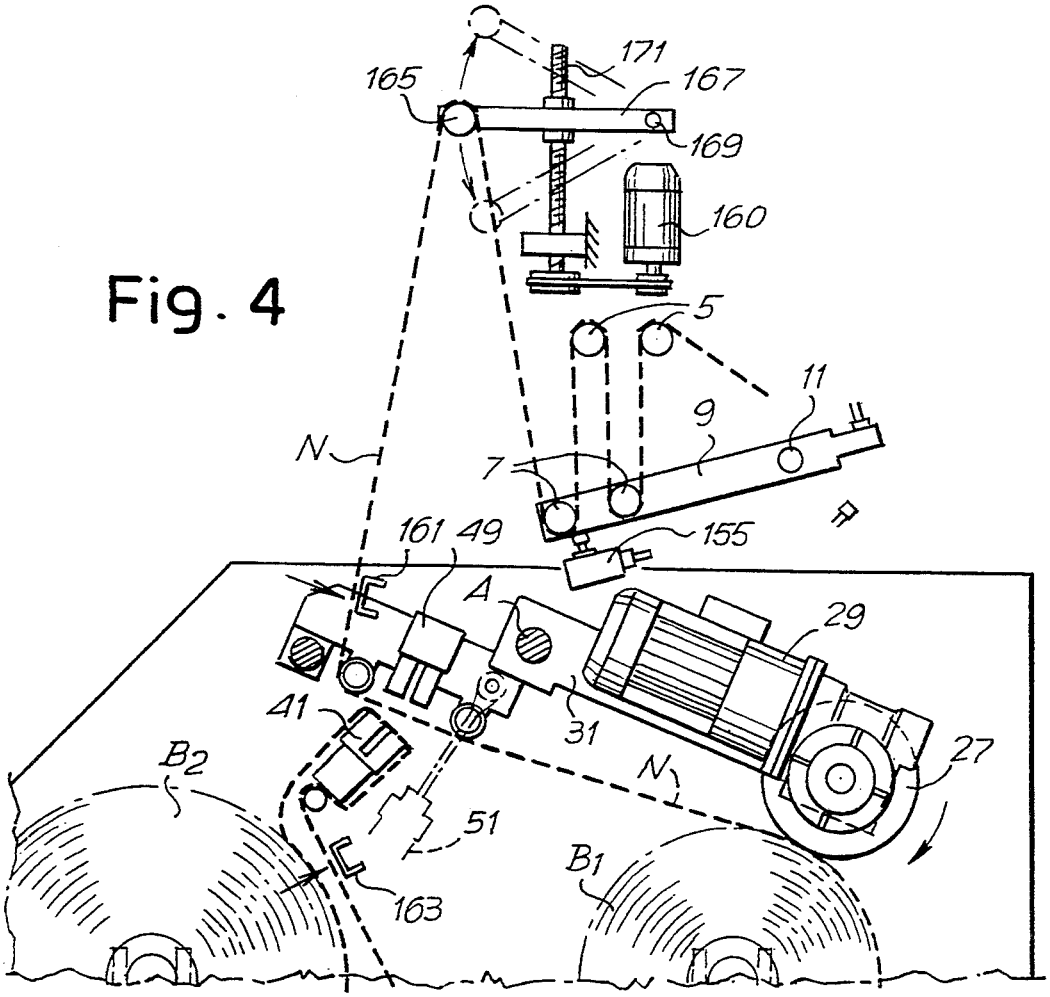

FIG. 4 shows in a very schematic way a modified embodiment of the means enabling the two strips to be brought into phase. Elements corresponding to FIGS. 2 and 3 are indicated by the same reference numbers. In this embodiment, instead of the two graduated scales 151 and 153, there are provided two reference points 161 and 163, one of which is disposed down-line from the bar 41 and counter-bar 49, between these and the accordion fold formed by the return rollers 5 and 7, while the other is disposed under the bar 41 next to the position of the free edge L of the strip from the reserve reel N2. The path of the strip includes, in addition to the accordion fold formed by the return rollers 5 and 7, a further return roller 165 carried by an arm 167 which oscillates about the axis 169, the position of which may be set at the start of each processing operation.

To enable the angular position of the arm 167 to be set, there is provided a threaded rod 171 which may be controlled by a handwheel or by an electric motor 169 suitably provided with an encoder and controlled by the control unit 60 for the purposes described subsequently. The principle of operation of this embodiment is conceptually analogous to that described with reference to FIGS. 3 and 5. However, in this case, instead of finding the position of a tag with respect to a graduated scale, it is necessary to initially position the strip in such a way that a reference tag printed on it is brought exactly next to the fixed reference 161. This is done before the start of processing, by changing the angular position of the arm 167 and consequently the path of the strip between the transverse means of welding and cutting 41, 49 and section 13 in which the bag closing and cutting pincers are located.

The procedure for phasing, or bringing into step, the strips from reels $B_1$ and $B_2$ with the references illustrated in FIG. 4 is as follows.

Before the start of processing, the strip from reel $B_1$ is disposed in the path determined by the return rollers and fed into the bag forming, filling and sealing section 13, in such a way that one of the reference tags printed on the strip is next to the pincers for closing and cutting the filled bags. In this state, the oscillating arm 9 is brought into its lower position delimited by the microswitch 155, corresponding to the predetermined length of the path of the strip between the accordion fold and the pincers in section 13. At this point the arm 167 is made to oscillate until it brings a reference tag of the strip next to the reference 161. In order to have the correct phasing between the strip on reel $B_1$ and the strip on reel $B_2$ when the join is made, it is sufficient for the edge L of the strip on the reserve reel $B_2$ to be positioned in such a way that one of the reference tags printed on it is brought next to the second reference 163. The position of the references 161 and 163 is chosen in such a way that the length of strip between the reference 161 and the section in which the welding between the two strips takes place corresponds to the length of strip between the said section and the reference 163.

Since with a change of the strip being processed (and consequently of the interval between the tags printed on the strip) the position of the arm 167 has to be modified in such a way that a reference tag is still brought next to the reference 161, if the position of the said arm 167 is regulated by means of the motor 169 which has been suitably provided with an encoder, it is possible to store in the control unit 60 a plurality of positions of the arm 167 corresponding to the different intervals between the reference tags of different strips which may be used in the machine. In this way it is extremely easy to bring the machine back into phase on changing the type of strip, since it is sufficient to enter the type of strip used or the interval between successive reference tags of the said strip in the control unit, after which the said control unit 60, on the basis of the stored data, brings the arm 167 into the correct position, in other words into the position in which the path of the strip between the welding and cutting means 41, 49 and the pincers of section 13 is such as to enable the strip being processed and the reserve strip to be brought into phase when the reference tag of the reserve strip is next to the reference 163.

Figure 6:
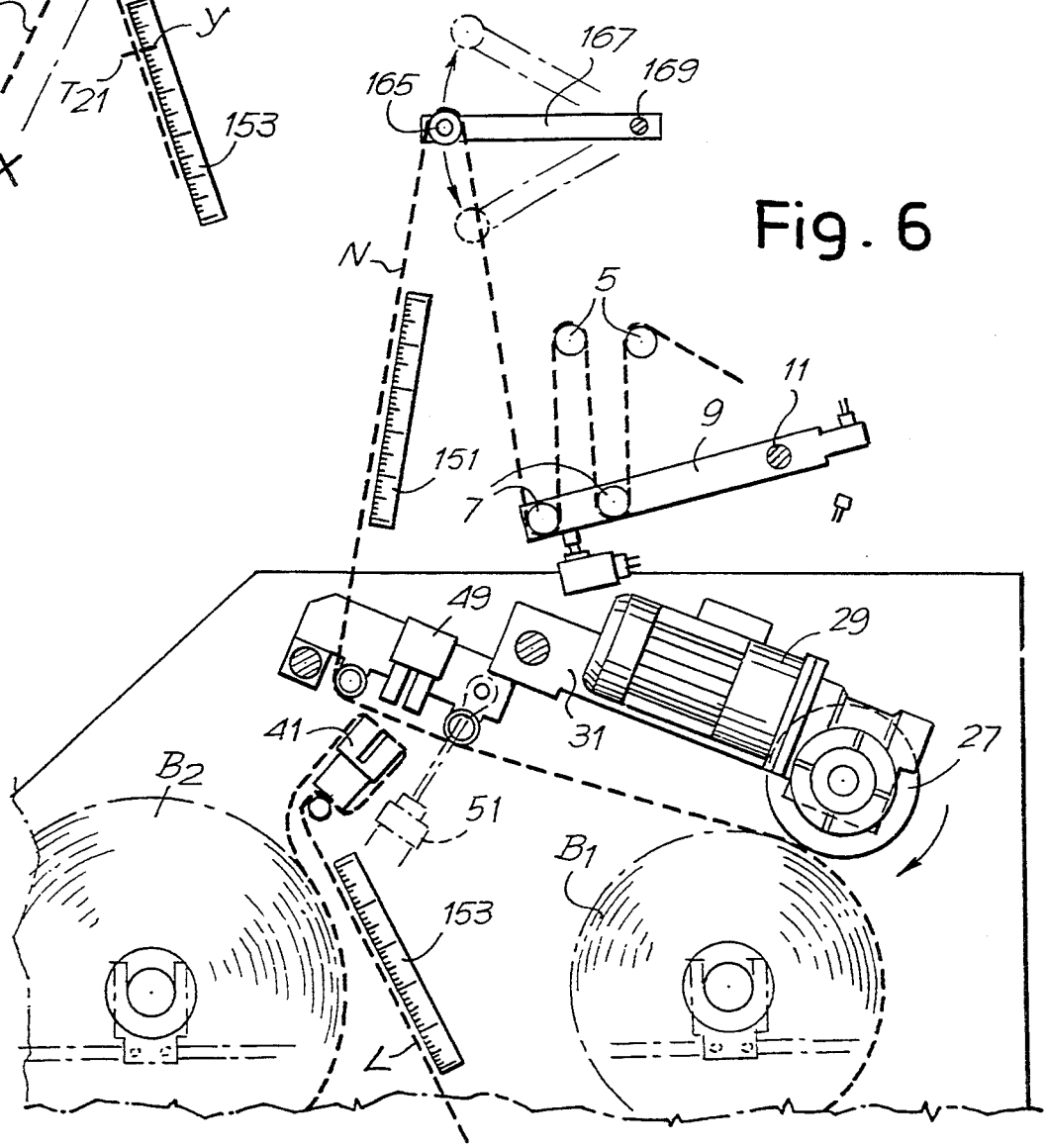
FIG. 6 shows a third embodiment of the machine according to the invention.

In the two solutions illustrated above, the weld made by the means 41 and 49 between the two strips on reels $B_1$ and $B_2$ is located at a random position between two consecutive reference tags. Consequently, the arrangements described above enable the two strips to be perfectly phased, but do not permit the determination of the position of the join a priori with respect to the reference tags, and therefore do not permit, finally, the determination of the position of the join in the bag which will be produced with the section of strip containing the said join. By combining the two solutions illustrated in FIGS. 3 and 4 it is possible not only to obtain perfect phasing of the two strips at the time of joining, but also to set the position of the join within the interval between two successive reference tags. This combined solution is illustrated in FIG. 6. In this case, before the processing is started, the arm 167 is brought into a position such that one of the reference tags on the strip from reel $B_1$ is located next to a certain index on the scale 151. The strip from reel $B_2$ is positioned next to the index with the same value on the scale 153, according to the procedures described with reference to FIGS. 3 and 5. In this position, the point where the join line defined by section X of FIG. 5 falls may be checked. If this position is incorrect, or does not correspond to the desired position with respect to the reference tags, it is sufficient to modify the position of the arm 167 and of the roller 165 until the reference tag on scale 151 is brought to a new index and to check where the join line is located with respect to the tags printed on the strip. By successive adjustment operations of this type it is possible to determine, by means of the roller 165, a path of the strip which enables the join to be obtained at the desired point with respect to the two consecutive tags on the welded strips.

The strips are brought back into step as described with reference to FIGS. 3 and 5 by bringing the tag on the free edge L of the strip from reel $B_2$ next to the index with the same value on scale 153.

The welding for the joining of the two strips may take place by various procedures: a hot bar or a heat pulse system may be used. The hot bar system is conventionally used in machines of this type, while the heat pulse system is not currently used in these applications, but has proved to be particularly-suitable. With this system, it is possible to obtain a very thin and smooth weld line, in other words without the wrinkles typical of welds made with a hot bar. This facilitates the subsequent passage of the weld line into the collar 15 of the bag forming, filling and closing section 13.

The welding system described above enables the new strip to be trimmed automatically without the necessity of making a finished leading edge as is required in joining systems of the manual type, which use, for example, strips of adhesive material or similar.

The passage of the area of welding together of two strips into the collar 15 of the bag forming, filling and closing section 13 is a critical phase of the operation of the packaging machine, since inside the collar 15 the strip must be subjected to bending to form, with a longitudinal weld, a tube from which the individual bags filled with the loose material will subsequently be formed by welding and transverse cutting. The bending to which the strip in the collar 15 is subjected causes a high level of stress in the material, which may prove to be critical in the section of the weld between two successive strips. In order to avoid problems such as the jamming of the material or tearing and subsequent stopping of the machine, the invention proposes three different procedures for controlling the passage of the weld line between consecutive strips into the collar 15.

In the first procedure, it is specified that a certain number of bags or a predetermined length of strip be entered in the control unit 60. After the unit 60 has activated the strip welding and cutting means 41, 49, in other words after the join has been made between the strip being used up and the reserve strip, the machine makes a number of bags corresponding to the number of bags or to the length of strip previously entered in the central unit 60. This entered length or this entered number corresponds approximately to the length of the path of the strip between the Joining means and the collar. After this number of bags has been made, the central unit causes the machine to stop and may cause an acoustic or visual warning signal to be emitted. At this point, the operator, manually drawing the bags into section 13, will make the area of transverse welding between the consecutive strips pass gently through the collar 15, and will then restart the packaging machine.

According to a further operating procedure, a number of bags or a length of strip substantially corresponding to the length of the path of the strip between the welding and cutting means 41, 49 and the collar 15 is entered in the central unit 60. When the central unit 60 causes the join to be made by means of the bar 41 and the counter-bar 49, it also simultaneously causes the machine to slow down with a consequent reduction in the speed of advance of the strip through the collar 15. This reduced speed will be maintained for a period which permits the passage of the length of strip previously entered, or the production of the number of bags previously entered in the central unit. During the operation at reduced speed, the passage of the join area through the collar takes place. The central unit subsequently proceeds to return the speed of the machine to the normal operating level.

According to this procedure, the passage of the join area into the collar 15 is automatic, and the reduced speed limits the risk of damage in the join area. However, the advantage of the automation of the passage of the weld line between consecutive strips into the collar 15 is accompanied by a loss of production due to the interval of time in which the machine operates at reduced speed.

To eliminate this disadvantage, according to a third procedure for controlling the passage of the join through the collar 15, it is specified that two numbers of bags or two lengths of strip be entered in the central unit 60. For example, a first number of bags, equal to 20, and a second number, equal to 4, may be entered in the central unit 60. After having made the join, the central unit maintains the speed of advance of the strip at the normal operating speed for the whole of the time required for the production of 20 bags, in other words of a number of bags corresponding to the first number entered in the said unit. At this point, the join area will be near the collar 15, in other words it will have substantially passed through the whole of the section between the welding and cutting means 41, 49 and the packaging section 13. At this point, the central unit proceeds to reduce the strip advance speed to permit easy and safe passage of the join area through the collar 15. The reduced speed is maintained for the time necessary for the production of 4 bags, in other words of a quantity of bags equal to the second number entered in the central unit. The central unit then returns the speed of the machine to the normal operating level.

This third operating procedure makes it possible to completely automate the operations of the joining of the strips and the passage of the join area through the collar, without substantially affecting the productivity of the machine.

It is to be understood that the drawing shows only one embodiment provided solely as a practical demonstration of the invention, this invention being capable of being modified in its forms and arrangements without thereby departing from the scope of the guiding concept of the invention.

We claim:

1. A machine for the production of moldable plastic film bags from a strip reel, and for filling of the bags, comprising:

bag forming and filling means for forming a bag;

a first reel having a first strip wound thereon said first strip including a series of equidistant first bags;

a second reel having a second strip wound thereon, said second strip including a series of equidistant second bags;

a first support means for supporting said first reel in a reel unwinding position wherein said first strip is unwound and fed to said bag forming and filling means;

a second support means for supporting said second reel as a reserve reel in a waiting position;

conveyor means for moving said second reel from said waiting position to said unwinding position;

welding means for welding said first strip to said second strip, said welding means including a first welding component and a second welding component, said first welding component including receiving and holding means for receiving and holding a leading end of said second strip, said second welding component being positioned on a side of a trajectory of said second strip which is opposite said first component, said welding means having a down line side wherein said first strip is fed to said bag forming and filling means and having an up line side wherein said first strip is fed from said first reel;

first reference position means at a first reference position on a down-line side of said welding means, said first reference position means for detecting said first series of bags;

a second reference position means at a second reference position, disposed cooperating with said first welding component to detect said second series of bags at a second reference position, said second reference position being located in correspondence to said first welding component receiving and holding means adjacent said second strip when said receiving and holding means is holding said second strip;

sensing means for detecting the exhaustion of said first reel, said sensing means generating a sensing means signal;

means for delimiting a path of said first strip from said first reel to said bag forming and filling means including a first set of fixed rollers and a second set of movable roller, said second set of movable rollers being movable in position with respect to said first set of fixed rollers to move said first bags with respect to said first reference; and control means for receiving said sensing means signal and for stopping said bag forming and filling means and activating said welding means and said cutting means when one bag of said first bags has reached a predetermined position with respect to said reference and for activating said conveyor means to move said second reel from said waiting position to said unwinding position.

2. Machine according to claim 1, wherein said first set of rollers includes a registerable return roller, a position of said registerable return roller being registered at a start of processing of said first strip.

3. Machine according to claim 1, wherein said first component of said welding means is supported by an arm pivotable about an axis substantially parallel to an axis of said second reel, said first component of said welding means being movable towards and away from said second component of said welding means by said pivotable arm.

4. Machine according to claim 2, including manual means for the registration of the position of the said registrable return roller.

5. Machine according to claim 2, including motor means for registering the position of said registrable return roller, and an encoder to detect the position of said registrable return roller, and a central control unit wherein a number of position of said registrable return roller are stored in a form in which said positions may be retrieved, each position corresponding to a predetermined longitudinal dimension of the bag to be produced.

6. Machine according to claim 1, wherein said first and second reference means include graduated scales.

7. Machine according to claim 1, wherein after welding of said first and said second strip said control unit temporarily modifies the feeding speed of the strip to said bags forming and filling means, to facilitate the passage of the section of said strip in which the join is located through said bag forming and filling means.

8. Machine according to claim 7, wherein a predeterminable number of bags or a predeterminable length of strip is entered in said control unit and wherein, after having activated the cutting and welding of the first and second strip the control unit permits the forming, filling and sealing of a number of bags corresponding to the number of bags or to the length of strip entered in said control unit, after which the machine is stopped.

9. Machine according to claim 7, wherein a predeterminable number of bags or a predeterminable length of strip is entered in said control unit and wherein, after having activated the cutting and welding of the first and second strip the control unit reduces the speed of advance of the strip unit the number of bags or the length of strip entered in said control unit has passed, and then returns the speed of advance to the normal operating level.

10. Machine according to claim 7, wherein a first number of bags or a first length of strip and a second number of bags or a second length of strip are entered in said control unit and wherein, after having activated the cutting and welding of said first and second strip, said control unit causes the strip to advance at the normal operating speed for a length equal to the first length entered or corresponding to the first number of bags entered and then causes the speed of advance of the strip to be reduced until the second number of bags or the second length of strip entered has passed, and finally returns the speed of advance to the normal operating level.

11. Machine according to claim 1, wherein said sensing means detects the diameter of said first reel.

12. Machine according to claim 11, wherein said sensing means includes a switch means cooperating with a striker which is movable with respect to the said switch means, the position of said switch means and said striker with respect to each other being a function of the diameter of the first reel.

13. Machine according to claim 12, including a moving element pivoted on the frame of the machine and carrying a motorized roller for the unwinding of the first reel, said moving element and said roller moving about the axis of pivoting to the frame to follow the diameter of the first reel, said striker or said switch means being integral with said moving element and said switch means or said striker being fixed to the frame of the machine.

14. Machine according to claim 12, wherein said control unit is programmed in such a way that when the sensor means send said signal to the control unit, said control unit activates the welding and cutting means with a preset delay, enabling the residue of strip on said first reel to be used.

15. Machine according to claim 1, wherein said sensing means include a sensor detecting a mark provided on said first strip at a predetermined distance from the final edge of said strip.

* * * * *